US005224365A

United States Patent [19]

Dobbs

[11] Patent Number: 5,224,365

[45] Date of Patent: Jul. 6, 1993

[54] SIDE BAR LOCK DECODER

[76] Inventor: Jerry L. Dobbs, Rte. 2, Box 411E, Sand Springs, Okla. 74063

[21] Appl. No.: 927,466

[22] Filed: Aug. 10, 1992

[51] Int. Cl.[5] ..... E05B 19/20

[52] U.S. Cl. ..... 70/394; 33/540; 70/395; 70/398; 70/408; 70/495

[58] Field of Search ..... 70/394, 395, 397, 399, 70/495, 496, 398, 406, 408, 409; 33/539, 540

[56] References Cited

U.S. PATENT DOCUMENTS

| | | | |
|---|---|---|---|
| 2,309,677 | 2/1943 | Segal | 81/3 |
| 2,491,288 | 12/1949 | Strangman | 81/3 |
| 2,733,514 | 2/1956 | Pennington | 33/174 |
| 3,264,908 | 8/1966 | Moore | 81/3 |
| 4,120,184 | 10/1978 | Gerlach | 70/395 X |
| 4,156,375 | 5/1979 | Crasnianski | 81/3 R |
| 4,185,482 | 1/1980 | Nail | 33/540 X |
| 4,517,746 | 5/1985 | Easley | 33/540 |
| 4,535,546 | 8/1985 | Smith | 33/540 |
| 4,638,567 | 1/1987 | Leversee | 33/540 |
| 4,667,494 | 5/1987 | Joosten | 33/540 X |
| 5,172,578 | 12/1992 | Bitzios | 70/395 X |

FOREIGN PATENT DOCUMENTS

| | | | |
|---|---|---|---|
| 2388965 | 12/1978 | France | 70/394 |
| 0049199 | 4/1977 | Japan | 70/394 |
| 0051297 | 4/1977 | Japan | 70/394 |
| 0051298 | 4/1977 | Japan | 70/394 |

*Primary Examiner*—Lloyd A. Gall

*Attorney, Agent, or Firm*—Head & Johnson

[57] ABSTRACT

A side bar lock decoder has a pair of guide plates laminarly arranged between a pair of side plates. Key portions of the plates have notches spaced for alignment with the lock wafers. Narrow passages between the guide plates extend from each of the notches to the edges of the base portions of the plates at approximately normal fingertip positions when the base portions are hand held. Wires slidably disposed in each of the passages extend from an outer end of each of the notches beyond the grip edges. One end of the wires abuts one of the wafers when the wafers and the notches are aligned. Springs, bias each of the wires toward a threshold reference position within the notches. Plungers, one connected to each of the wires, extend beyond the grip edges, are independently biased away from their respective edges by the springs. One or more housings secured to the laminar plates have at least one chamber therein for guiding the movement of each of the plungers during manipulation. Windows in the housings allow viewing of the depth of each plunger in its housing and at least one graduated scale on each housing, corresponding to the graduated scale of wafer depths of the lock, indicates the position of each plunger in relation to its threshold reference position when the wafers are shifted into the "open lock" condition. Pins extend from each plunger externally of its housing to facilitate simultaneous finger manipulation of each plunger.

18 Claims, 4 Drawing Sheets

SIDE BAR LOCK DECODER

BACKGROUND OF THE INVENTION

This invention relates generally to high security locks and more particularly concerns side bar locks.

Side bar locks are used in a wide variety of applications, including, for example, ignition, door, trunk and glove compartment locks on motor vehicles. Once the lock is installed, it is desirable to have the ability to cut a key having the appropriate combination to open the lock without having to remove the lock from its mounting. Such removal is time consuming and could cause damage to the locked article as well as to the lock.

Various types of decoders have been devised for determining the combination of side bar locks. They generally involve a tedious, time consuming, sequential manipulation of individual wafers in order to determine the combination code wafer by wafer. When manipulation of each wafer is completed, the conversion of the information gained by the manipulation into useful decoding data is generally complicated and inaccurate.

It is, therefore, an object of this invention to provide a side bar lock decoder that is easy to use. Another object of this invention is to provide a side bar lock that can be manually manipulated to simultaneously determine the code values of all wafers in the lock.

SUMMARY OF THE INVENTION

Side bar locks have a plurality of spaced apart spring biased wafers coded by grooves in their side edges, the level of the grooves being coordinated to a graduated scale of wafer depths. When the groove of each wafer aligns with a spring biased side bar, the wafers have been shifted against their bias into an "open lock" condition.

In accordance with the invention, the side bar lock decoder has a pair of guide plates laminarly arranged between a pair of side plates. Each guide plate has a key portion and a base portion and the key portions extend externally of a forward edge of the side plates and have a plurality of notches spaced for alignment with the plurality of wafers in the lock when the key portions are inserted into the lock.

A plurality of narrow passages is defined between the guide plates. One passage begins at each one of the notches and extends to the edge of the base portions of the guide plates at approximately normal fingertip positions when the base portions are hand held. Typically, two passages extend to the upper and four to the lower grip portions.

A plurality of wires are slidably disposed in the passages, one extending from an outer end of each of the notches beyond the grip portion edges. One end of each of the wires abuts one of the wafers when the wafers and the notches are aligned. A spring is disposed in each of the notches, for biasing its wire toward a threshold reference position within the notch.

A plunger is connected to the other end of each of the wires and each of the plungers is independently biased away from the edge of the grip portion by a spring. Housings secured to the laminar plates have chambers for guiding the movement of each of the plungers during manipulation. Windows in the housings permit viewing of the depth of each of the plungers in relation to its housing. At least one graduated scale on each housing corresponding to the graduated scale of wafer levels which code the lock to indicate the position of each plunger in relation to its threshold reference position when the wafers are shifted into the "open lock" condition. A pin extends from each of the plungers externally of the housings to permit simultaneous finger manipulation of all the plungers, thus simultaneously sliding all of the wires in their passages against their independent bias springs to simultaneously shift all the wafers against their bias and into the "open lock" condition.

DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
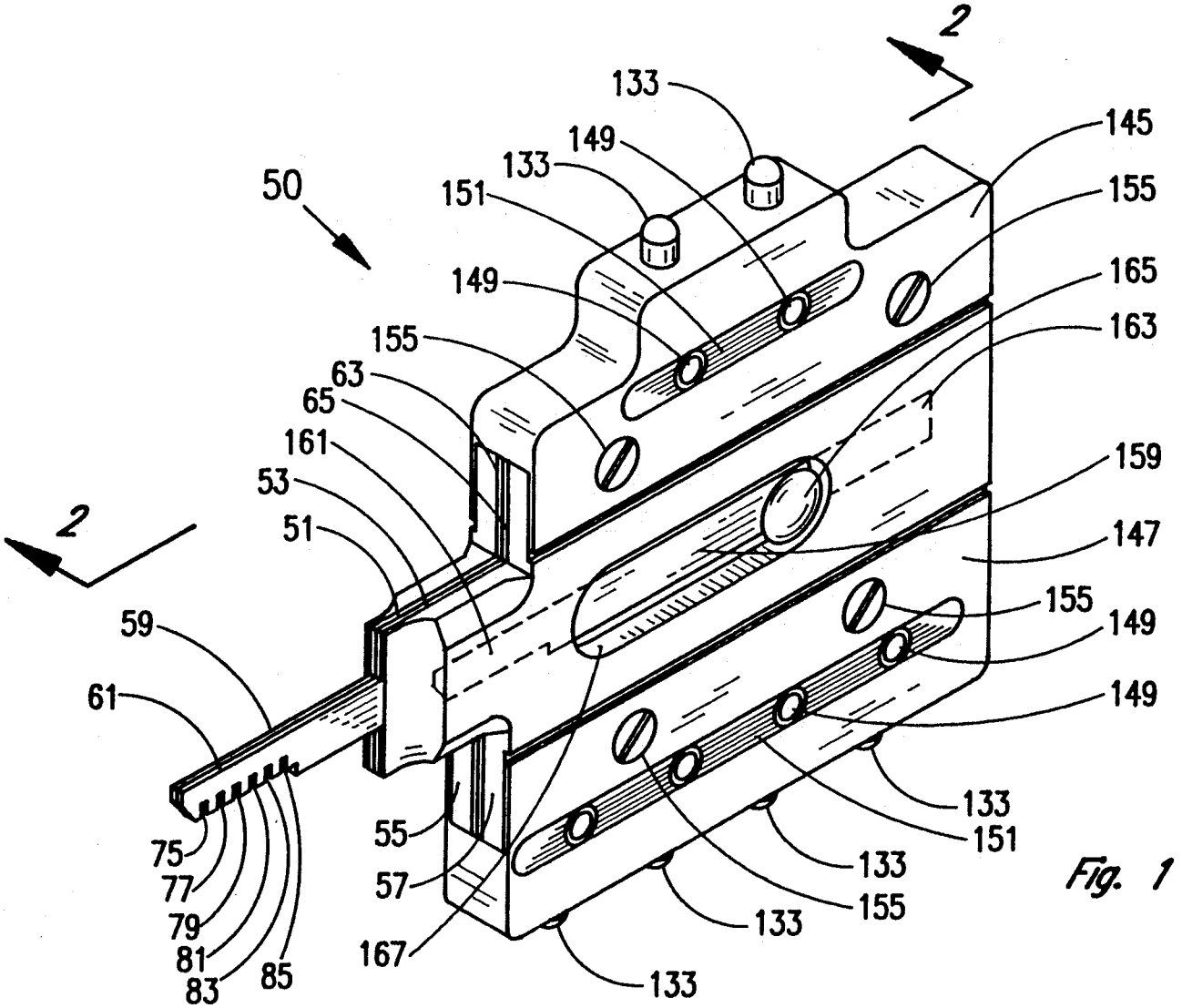
FIG. 1 is a perspective view of the side bar lock decoder.
Figure 2:
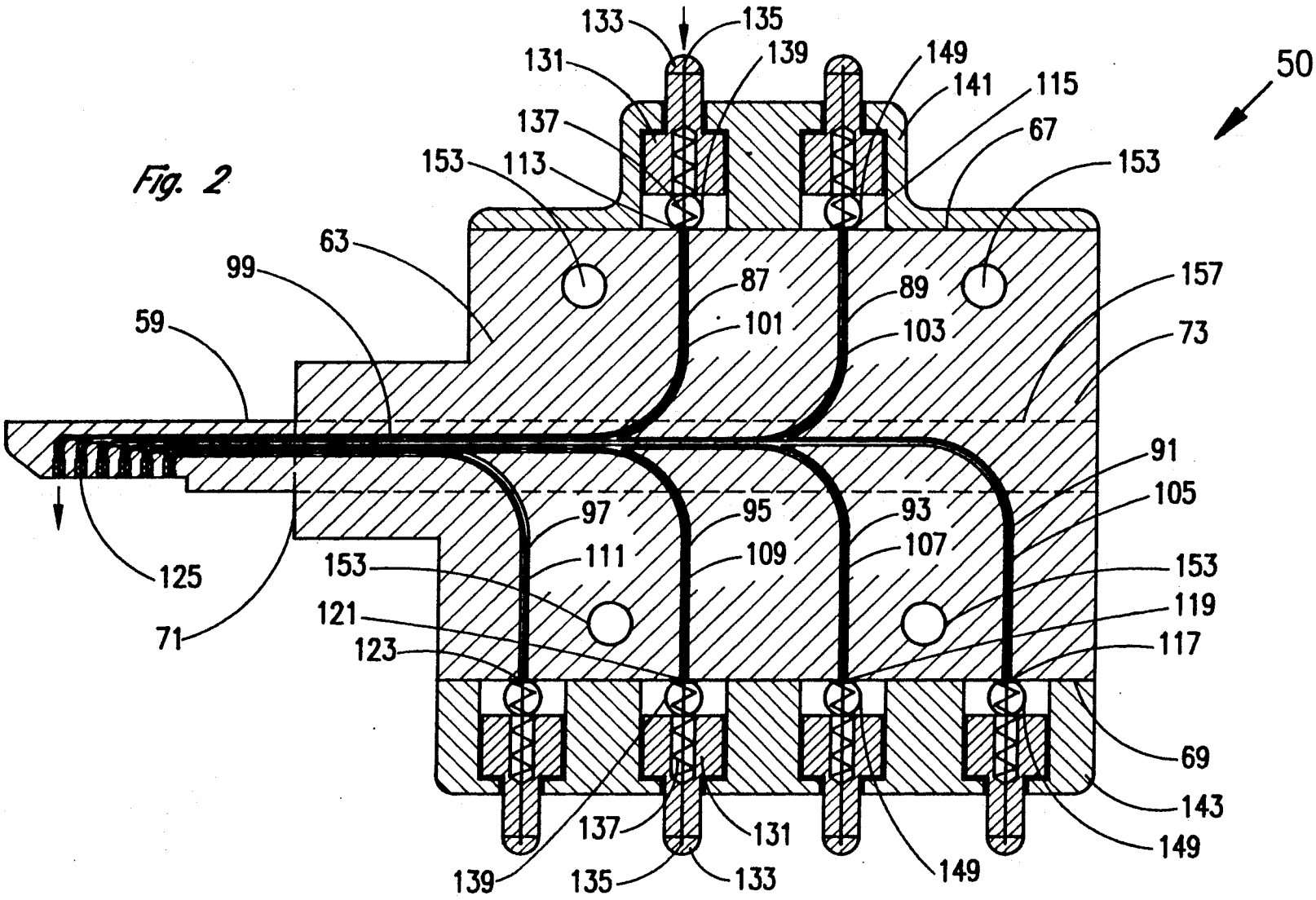
FIG. 2 is a cross-sectional view taken along the line 2—2 of FIG. 1.
Figure 3:
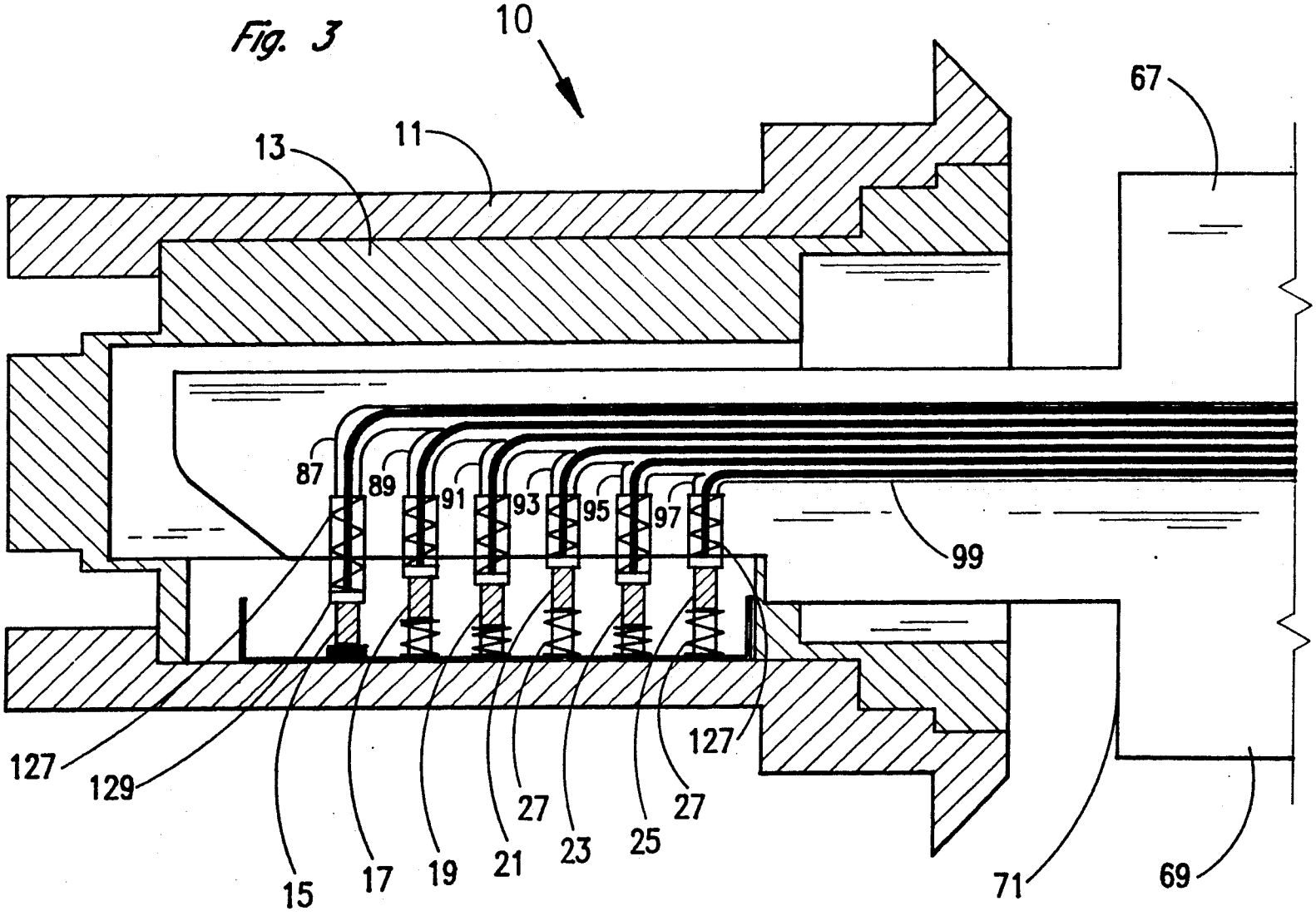
FIG. 3 an enlarged cross-sectional view of the key portion of the decoder of FIGS. 1 and 2 inserted in a side bar lock and manipulated to an "open lock" condition.

Looking generally at FIGS. 1, 2 and 3, a side bar lock 10 is to be decoded by a side bar lock decoder 50. As can best be seen in FIG. 3, the lock 10 consists of a housing 11 in which is mounted a cylinder 13 which contains a plurality of wafers which establish the code of the lock. The lock 10 illustrated in FIG. 3 employs six wafers 15, 17, 19, 21, 23 and 25.

Figure 4:
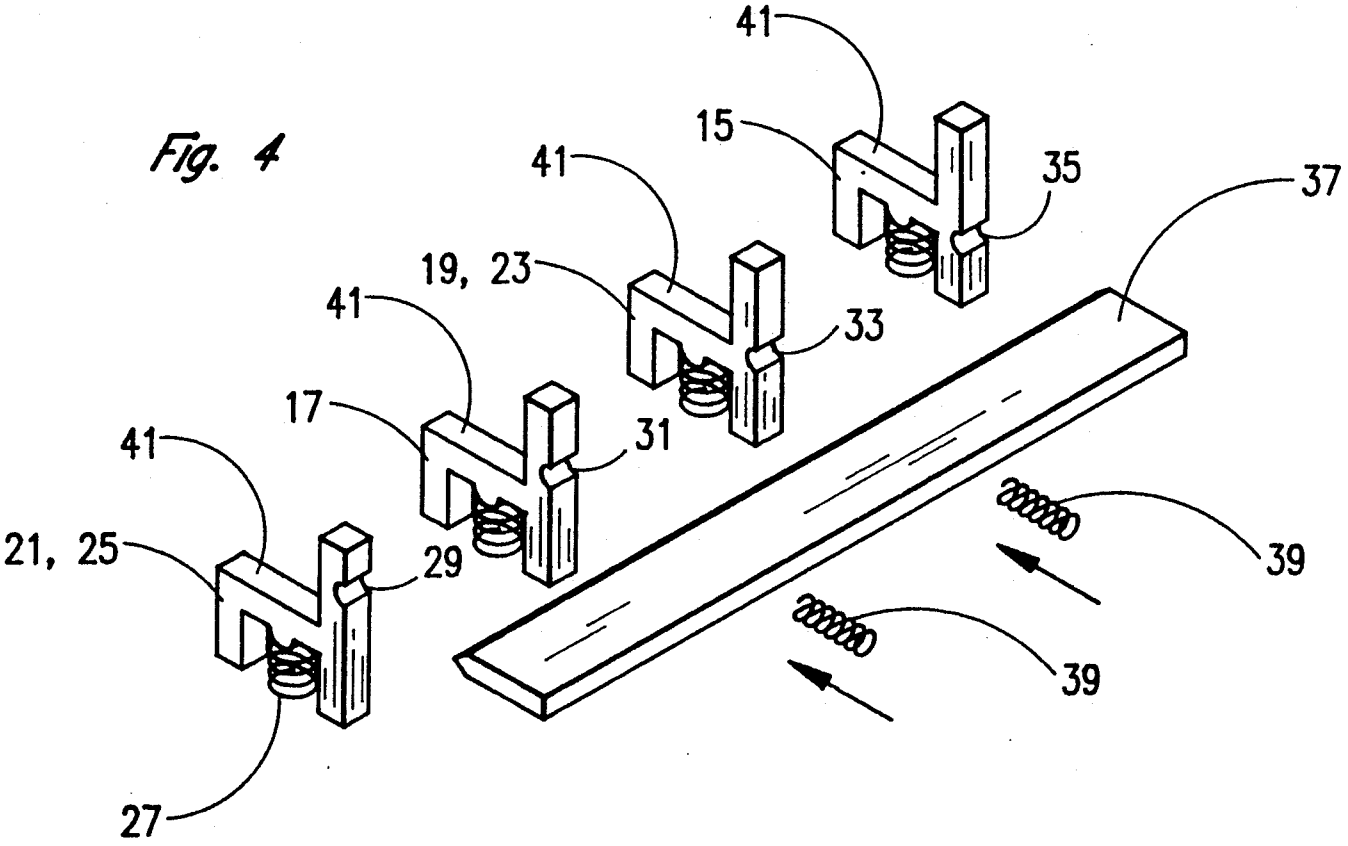
FIG. 4 is a side elevational view illustrating the coding of a side bar lock.

As can best be seen in FIG. 4, the wafers are coded by grooves 29, 31, 33 and 35 in the side of the wafer. Looking from left to right in FIGS. 1, 2 and 3, the grooves 29 of the fourth wafer 21 and the sixth wafer 25 are at the highest level and are normally referred to as code 1 wafers. The groove 31 in both the second wafer 17 is at the second highest level and is referred to as a code 2 wafer. The grooves 33 in both the third wafer 19 and the fifth wafer 23 are at the third highest level and are referred to as code 3 wafers. Finally, the groove 35 in the first wafer 15 is at the lowest level and is referred to as a code 4 wafer. Thus, the code of the lock 10 illustrated in FIG. 3 would be 4-2-3-1-3-1.

As shown in FIGS. 3 and 4, each of the wafers is biased by a separate wafer spring 27 seated against the housing 11 in the cylinder 13. In particular reference to FIG. 4, each spring 27 is compressible between the housing 11 and an opposing face of its respective wafer. When the wafers are moved against bias to allow the grooves to be in alignment, a side bar 37, under bias of side bar springs 39, seats in the grooves and allows the rotation of the cylinder 13 within the housing 11. The movement of the wafers to this "open lock" condition is normally accomplished by the use of the appropriate key (not shown) having teeth of varying depth to engage with the seats 41 in the wafers to shift the wafers against their bias to the proper depth to align the grooves 29.

Turning now to FIG. 1, the decoder 50 for decoding the lock 10 is illustrated. A pair of guide plates 51 and 53 are in laminar relation to each other and are laminated between a pair of side plates 55 and 57. The guide plates 51 and 53 have key portions 59 and 61 and grip or base portions 63 and 65. The grip portions 63 and 65 have an upper edge 67, a lower edge 69, a forward edge 71 and a rear edge 73. The key portions 59 and 61 extend forward of the forward edge 71, most clearly seen in FIG. 2.

As seen in FIG. 1, the key portions 59 and 61 have a plurality of notches in their lower edge. The notches are spaced at intervals so that they will be aligned with the wafers of the lock 10 when the key portions 59 and 61 are inserted into the lock cylinder 13. Since the lock 10 has six wafers, the decoder 50 illustrated in FIG. 1 has six notches 75, 77, 79, 81, 83 and 85, moving from left to right.

Looking at FIGS. 2 and 3, each of the notches is associated with a separate narrow channel or passage that extends from the notch through the case defined by the laminated plates 51, 53, 55 and 57. The first notch 75 communicates through a first passage 87, the second notch 77 through a second passage 89 and so forth to the sixth notch 85 which communicates with a sixth passage 97. Each of these passages is formed or defined by a channel cut into the face of one of the guide plates 51 which abuts the other guide plate 53. Thus, the lamination of the plates 51 and 53 with the channels between them results in an open communication passage extending from each notch through the key portions 59 and 61 and the grip portions 63 and 65. As shown in FIG. 2, the separate channels may, at least in part, be combined into one or more main or trunk channels 99.

Each channel has a wire slidably disposed in it, the decoder 50 shown having six wires 101, 103, 105, 107, 109 and 111 as shown. Each of the wires extends through a port 113, 115, 117, 119, 121 and 123 disposed along the upper and lower edges 67 and 69 of the grip portions 63 and 65 of the decoder 50. One end of each of the wires extends to the outer end 125 of each of the notches. As can best be seen in FIG. 3, each notch has a notch spring 127 secured between the key portions 59 and 61 and the wires extend through the springs 127 to an end face or a disk 129 at the end of each wire. The notch springs 127 bias the positioning of the disks 129 to the outer edge 125 of the notches in their normal or relaxed condition. Thus, when the key portions 59 and 61 are inserted into the lock cylinder 13, the disks 129 abut the seats 41 on the wafers. Preferably, the wafer bias is greater than the notch spring bias so that the wafers will penetrate partially into their notches.

As can best be seen in FIG. 2, each of the wires extends through its respective channel so that, when one end of the wire is positioned with its disk 129 aligned with the outer edge 125 of its notch, the other end of the wire extends through its respective port to a plunger 131 having a shaft or pin 133 extending from it. As shown, the extension 135 of each of the wires is fixed to the plunger 131 or its shaft 133 at a suitable connection point 135 and a bias spring 137 is disposed between the face of the plunger 131 and the edge 67 or 69 of the grip portions 63 and 65. Thus, movement of the plunger 131 against its spring bias 137 will cause its respective wire to slidably shift within its channel and cause its disk 129 to be driven against its wafer.

The narrowness of the channel is such that the wires slide along the length of the channel and do not substantially flex or bend within the channel. That is, the displacement of one end of the wire will be substantially the same as the displacement of the other end of the wire.

To hold the plungers 131 and springs 137 in place, a plurality of plunger chambers 139 are defined within an upper housing 141 and a lower housing 143. As can best be seen in FIG. 1, each of the housings has a U-shaped bracket 145 and 147 within which the laminarly arranged guide plates 51 and 53 and side plates 55 and 57 are sandwiched. Each of the plungers 133 has an associated window 149 through its respective housing which permits an operator to view the position of the face of the plunger 131 abutting the plunger biasing spring 137. A graduated scale 151 is provided adjacent each window 149, the scale corresponding to the graduated scale of wafer depth associated with the lock code. The pins or shafts 133 of the plungers 131 extend externally of the respective housings 141 and 143 so that the plungers 131 and therefore their wires can be manipulated by finger manipulation of the pins 133 against the spring bias 137.

As seen in FIG. 2, holes are provided through the U-shaped brackets 145 and 147, the guide plates 51 and 53 and the side plates 55 and 57 to permit the use of bolts 155 as shown in FIG. 1 to secure the components of the decoder 50 together. It may be further desirable to use small screws or other fastening means (not shown) to assure rigid connection of the key portions 59 and 61 of the guide plates 51 and 53, thus assuring that the notch springs 27 and the wires will be secure in their channels in the key portions 59 and 61.

In operation, the key portions 59 and 61 of the decoder 50 are inserted into the lock cylinder 13 until the wafers are aligned with their respective notches in the decoder 50. Preferably, the depth of the notches will be such that the seats 41 on the wafers will slightly penetrate into the notches and assure a proper and firm alignment. With the key portions 59 and 61 of the decoder 50 so inserted, grip portions 63 and 65 of the decoder 50 are held in the hands. In the embodiment of the decoder 50 illustrated in FIGS. 1, 2 and 3, two plungers are located along the upper edge of the grip portions 63 and 65 and four plungers along the lower edge of the grip portions 63 and 65. Their location is such as to allow four fingers of one hand to have their tips engaged with the pins 133 of the lower plungers 131, the index finger being in contact with the plunger 131 closest to the forward edge 71 of the decoder 50, and for the thumbs of both hands to be disposed on the pins 133 of the upper plungers 131. Thus, all of the plungers 131 can be comfortably, simultaneously finger manipulated. This in turn causes the wires to slide in their channels, shifting the position of the disks 129 and, therefore, shifting the depth of each wafer against its bias. The operator uses fingertip sensitivity and manipulation to align all of the grooves in the wafers with the side bar 37, at which time the side bar 37 penetrates the grooves and holds the wafers in an "open lock" condition. With the side bar 37 engaged with the wafer grooves, the position of the plungers 131 is fixed and the operator, by simply reading the graduated scale level of each plunger, decodes the lock.

While the embodiment herein illustrated employs a substantially rectangular grip portion with four plungers on the lower portion and two on the upper portion of the decoder, any arrangement or configuration comfortable to the grip and any disposition of plungers adapted to the natural positioning of the fingers and thumbs in a grip position may be employed. Furthermore, while the present embodiment is designed to accommodate a six wafer lock, one could readily modify the design of the decoder to accommodate locks of different numbers of wafers. For example, as many as ten wafers might be accommodated by use of eight plungers on the lower edge of the decoder and two on the upper edge, with the fingers of both the right and left hand manipulating the lower plungers and the thumbs operating the upper plungers. It will also be apparent that one could use a decoder having more notches, channels and plungers than the lock to be decoded has wafers.

The decoder 50 may also be provided with an elongated slot 157 extending from the rear edge 73 through the front edge 71 of the grip portion 63 or 65 in either of the side plates 55 or 57. This slot 157 allows the user to slide a flat member 159 having a front key portion 161 and a rear portion 163 in the decoder 50 in a laminar relationship between one of the guide plates 51 or 53 and one of the side plates 55 and 57. A button 165 is provided on the member 159 and a window 167 through the side and guide plates to facilitate sliding of the member 159. The key portion 161 of the flat member 159 has no notches and is slidable to overlap the key portions 59 and 61 of the guide plates 51 and 53. With the flat member 159 so positioned, the key portions 59, 61 and 161 of the decoder 50 and the flat member 159 can be inserted into the lock cylinder 13 without any possibility of the wafers penetrating the notches and interrupting insertion before full insertion has occurred. Once the key portions 59, 61 and 161 are fully inserted, the flat member 159 can be retracted to allow the wafers to partially penetrate into the notches.

Thus, it is apparent that there has been provided, in accordance with the invention, a side bar lock decoder that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For use by finger manipulation with locks having a plurality of spaced apart spring biased wafers coded by grooves in side edges thereof according to a graduated scale of wafer depths, the groove of each wafer aligning with a spring biased side bar when the wafers are shifted against their bias into an "open lock" condition, a decoder comprising:

a case having a key portion and a grip portion, said key portion having a plurality of notches spaced for alignment with the plurality of wafers when said key portion is inserted into said lock, said case having a plurality of narrow passages therethrough, one extending from each of said notches to one of a plurality of ports exiting said grip portion of said case at approximately normal fingertip positions when said grip portion is hand held;

a plurality of wires, one slidably disposed in each of said passages from an outer end of each of said notches and extending through each of said ports, and means on one end of each of said wires for abutting one of each of said wafers when said wafers and said notches are aligned; and a plurality of means, one connected to each of said wires at another end thereof extending through each of said ports and each independently biased against movement toward said case, for simultaneously finger manipulating each of said wires to slide said wires in said passages against said independent bias to shift the wafers against the wafer bias into the "open lock" condition.

2. A decoder according to claim 1 further comprising a plurality of means, one disposed in each of said notches, for biasing said one end of each of said wires toward a threshold reference position.

3. A decoder according to claim 2 further comprising means positioned in relation to each of said manipulating means for indicating the position of each of said one ends of said wires in relation to said threshold reference position when said wafers are shifted into the "open lock" condition.

4. A decoder according to claim 3, said indicating means comprising at least one window in said case for viewing the position of each of said manipulating means.

5. A decoder according to claim 4, said indicating means further comprising a graduated scale on said case proximate said at least one window corresponding to the graduated scale of wafer depths.

6. For use by finger manipulation with locks having a plurality of spaced apart spring biased wafers coded by grooves in side edges thereof according to a graduated scale of wafer depths, the groove of each wafer aligning with a spring biased side bar when the wafers are shifted against their bias into an "open lock" condition, a decoder comprising:

a pair of guide plates laminarly arranged, each having a key portion and a base portion, said key portions having a plurality of notches spaced for alignment with the plurality of wafers when said key portions are inserted into said lock, at least one of said guide plates having a plurality of narrow channels in a face abutting the other of said plates, one said channel extending from each of said notches to one of a plurality of ports spaced along a perimeter of said base portion of said at least one plate at approximately normal fingertip positions when said base portions are hand held;

a pair of side plates laminarly arranged with said guide plates therebetween and said key portions extending externally of said side plates;

a plurality of wires, one slidably disposed in each of said channels and extending between said guide plates from an outer end of each of said notches through each of said ports and means on one end of each of said wires for abutting one of each of said wafers when said wafers and said notches are aligned; and a plurality of means, one connected to each of said wires at another end thereof extending through each of said ports and each independently biased against movement toward said ports, for simultaneously finger manipulating each of said wires to slide said wires in said channels against said independent bias to shift the wafers against the wafer bias into the "open lock" condition.

7. A decoder according to claim 6 further comprising a plurality of means, one disposed in each of said notches, for biasing said one end of each of said wires toward a threshold reference position.

8. A decoder according to claim 7 further comprising a plurality of means, one corresponding to each of said manipulating means, for indicating the position of each of said one ends of said wires in relation to said threshold reference position when said wafers are shifted into the "open lock" condition.

9. A decoder according to claim 8, said indicating means comprising a plurality of windows, one for viewing the position of each of said manipulating means.

10. A decoder according to claim 9, said indicating means further comprising a plurality of graduated scales, one proximate each of said windows, said scales corresponding to the graduated scale of wafer depths.

11. For use by finger manipulation with locks having a plurality of spaced apart spring biased wafers coded by grooves in side edges thereof according to a graduated scale of wafer depths, the groove of each wafer aligning with a spring biased side bar when the wafers are shifted against their bias into an "open lock" condition, a decoder comprising:

a pair of guide plates laminarly arranged, each having a key portion and a base portion, said key portions having a plurality of notches spaced for alignment with the plurality of wafers when said key portions are inserted into said lock, at least one of said guide plates having a plurality of narrow channels in a face abutting the other of said plates, one said channel extending from each of said notches to one of a plurality of ports spaced along a perimeter of said base portion of said at least one plate at approximately normal fingertip positions when said base portions are hand held;

a pair of side plates laminarly arranged with said guide plates therebetween and said key portions extending externally of said side plates;

a plurality of wires, one slidably disposed in each of said channels between said guide plates and extending from an outer end of each of said notches through each of said ports, and means on one end of each of said wires for abutting one of each of said wafers when said wafers and said notches are aligned;

a plurality of springs, one disposed in each of said notches, for biasing said one end of each of said wires toward a threshold reference position;

a plurality of plungers, one connected to another end of each of said wires extending through each of said ports, each said plunger being independently biased away from each said port by one of a plurality of spring means, for simultaneously finger manipulating each of said wires to slide said wires in said channels against said independent bias to shift the wafers against the wafer bias into the "open lock" condition; and at least one housing secured to said laminar plates and having a plurality of chambers therein for guiding said plungers during manipulation thereof, said at least one housing having windows therein for viewing the position of each of said plungers and having at least one graduated scale thereon corresponding to the graduated scale of wafer depths for indicating the position of each of said plungers in relation to said threshold reference position when said wafers are shifted into the "open lock" condition.

12. A decoder according to claim 11, said key portions having a depth such that the wafers penetrate partially into their respective ones of said notches when said key portions are inserted into said lock and the wafers are aligned with said notches.

13. For use by finger manipulation with locks having a plurality of spaced apart spring biased wafers coded by grooves in side edges thereof according to a graduated scale of wafer depths, the groove of each wafer aligning with a spring biased side bar when the wafers are shifted against their bias into an "open lock" condition, a decoder comprising:

a pair of guide plates laminarly arranged, each having a key portion and a base portion, said key portions having a plurality of notches spaced for alignment with the plurality of wafers when said key portions are inserted into said lock;

a pair of side plates laminarly arranged with said guide plates therebetween and said key portions extending externally of a forward edge of said side plates;

a plurality of narrow passages defined between said guide plates, one said passage extending from each of said notches, at least one extending to an upper edge of said base portions of said guide plates and the remainder of said passages extending to a lower edge of said base portions of said guide plates at approximately normal fingertip positions when said base portions are hand held;

a plurality of wires, one slidably disposed in each of said passages and extending from an outer end of each of said notches beyond said upper and lower edges, and means on one end of each of said wires for abutting one of each of said wafers when said wafers and said notches are aligned;

a plurality of springs, one disposed in each of said notches, for biasing said on end of each of said wires toward a threshold reference position within said notches;

a plurality of plungers, one connected to another end of each of said wires extending beyond said upper and lower edges, each of said plungers being independently biased away from their respective edges by one of a plurality of springs disposed therebetween;

a first housing secured to said laminar plates and having at least one chamber therein, one for guiding the movement of each of said upper edge plungers during manipulation thereof;

a second housing secured to said laminar plates and having at least one chamber therein, one for guiding the movement of each of said lower edge plungers during manipulation thereof;

a plurality of windows in said housings, one for viewing the depth of each of said plungers in its respective said housing;

at least one graduated scale on each said housing corresponding to the graduated scale of wafer depths for indicating the position of each of said plungers in relation to said threshold reference position when said wafers are shifted into the "open lock" condition; and a plurality of pins, one extending from each of said plungers externally of said housings for simultaneously finger manipulating each of said plungers to slide said wires in said passages against said independent bias springs to shift the wafers against the wafer bias into the "open lock" condition.

14. A decoder according to claim 13, said key portions having a depth such that the wafers penetrate partially into their respective ones of said notches when said key portions are inserted into said lock and the wafers are aligned with said notches.

15. A decoder according to claim 13 having six notches on said key portions, two passages extending to said upper edge and four passages extending to said lower edge.

16. A decoder according to claim 13, each of said housings having a U-shaped bracket with said laminated plates being sandwiched therebetween.

17. A decoder according to claim 13, said one end of each of said wires extending through its respective threshold reference spring and having a disk fixed thereto for abutment with its respective wafer.

18. A decoder according to claim 13 further comprising an elongated slot extending rearwardly between one of said guide plates and one of said side plates from said key portions at said forward edge of said side plates and a flat elongated member having an unnotched forward key portion slidable in said slot between a forward position with said forward key portion overlapping said guide plate key portions and a rearward position with said forward key portion retracted from said guide plate key portions.

* * * * *